US009508511B2

(12) United States Patent
Legendre et al.

(10) Patent No.: US 9,508,511 B2
(45) Date of Patent: Nov. 29, 2016

(54) SINGLE-POLE SWITCHING UNIT AND SWITCHING UNIT COMPRISING ONE SUCH UNIT

(71) Applicant: SCHNEIDER ELECTRIC INDUSTRIES SAS, Rueil-Malmaison (FR)

(72) Inventors: Philippe Legendre, Grenoble (FR); Jean-Paul Gonnet, Fontaine (FR); Denis Giraud, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/592,294

(22) Filed: Jan. 8, 2015

(65) Prior Publication Data

US 2015/0200066 A1 Jul. 16, 2015

(30) Foreign Application Priority Data

Jan. 13, 2014 (FR) ..... 14 50227

(51) Int. Cl.
*H01H 33/86* (2006.01)
*H01H 9/34* (2006.01)
(Continued)

(52) U.S. Cl.
CPC ..... *H01H 33/86* (2013.01); *H01H 9/342* (2013.01); *H01H 33/73* (2013.01); *H01H 77/02* (2013.01); *H01H 2009/343* (2013.01); *H01H 2077/025* (2013.01)

(58) Field of Classification Search
CPC ..... H01H 2009/343; H01H 9/342; H01H 9/345; H01H 77/02; H01H 33/86; H01H 33/73
USPC ..... 218/31, 30, 46, 48, 110, 154, 157
See application file for complete search history.

(56) References Cited

U.S. PATENT DOCUMENTS 6,373,357 B1 * 4/2002 Douville ..... H01H 77/02 335/172
6,750,743 B1 * 6/2004 Subramanian ..... H01H 1/2058 335/8

(Continued)

FOREIGN PATENT DOCUMENTS

FR 2 986 659 A1 8/2013
GB 2 238 664 A 6/1991

OTHER PUBLICATIONS

French Preliminary Search Report issued Sep. 12, 2014, in French Application No. 14 50227 filed Jan. 13, 2014 (with English Translation of Categories of Cited Documents).

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

The invention relates to a single-pole switching unit having a housing comprising a moving contact bridge and a pair of fixed contacts cooperating with said moving contact bridge and respectively connected to a current intake conductor, two electric arc cutoff chambers respectively opening onto an open volume of the moving contact bridge, each cutoff chamber being connected to at least one exhaust channel (42). The exhaust channel (42) comprises a rotating gate (48) designed to be rotated around an axis substantially perpendicular to the exhaust channel (42) by the passage of switching gases. The rotating gate (48) comprises an edge (54) positioned across from an inner wall (56) of the exhaust channel, in the first obstruction position. The arrangement of the rotating gate (48) and the inner wall (56) is such that the distance between said edge (54) and said inner wall (56) remains constant and equal to said first distance up to a first threshold value of the angle of rotation of the rotating gate (48), then increases linearly up to a second rotation angle threshold value corresponding to complete opening of the discharge channel. The invention also relates to a switching unit comprising at least one single-pole switching unit.

8 Claims, 6 Drawing Sheets

(51) Int. Cl.
*H01H 77/02* (2006.01)
*H01H 33/73* (2006.01)

(56) References Cited

U.S. PATENT DOCUMENTS 6,930,573 B2 * 8/2005 Ciarcia ..... H01H 1/2058 335/8
8,487,204 B2 * 7/2013 Scola ..... H01H 71/0207 218/157
2009/0065341 A1 * 3/2009 Shmukler ..... H01H 77/104 200/400
2012/0026638 A1 2/2012 Ahlert
2012/0175348 A1 * 7/2012 Anglade ..... H01H 1/2058 218/157

* cited by examiner

SINGLE-POLE SWITCHING UNIT AND SWITCHING UNIT COMPRISING ONE SUCH UNIT

BACKGROUND ON THE INVENTION

The present invention relates to a single-pole switching unit. It also relates to a switching unit comprising at least one single-pole switching unit.

It belongs to the field of switching units, in particular high-power, low-voltage circuit breakers, in which the discharge of the switching gases is used to trigger a current switching mechanism.

In such switching units, it is necessary to trigger the mechanism opening the circuit breaker once an arc appears in the cutoff chamber.

Various solutions have been proposed to achieve quick triggering.

Patent application FR2986659 describes a modular switching unit, comprising improved pneumatic triggering means.

This document describes a switching unit comprising at least one single-pole switching unit, and preferably three single-pole switching units, each single-pole switching unit being connected to a triggering unit at a downstream contact. Each single-pole switching unit also comprises an upstream contact, making it possible to connect it to a current line. Such a single-pole switching unit comprises a housing comprising a moving contact bridge and connected to the contact areas, as well as two electric arc cutoff chambers opening onto an open volume of the contact bridge, each cutoff chamber being connected to at least one switching gas exhaust channel. If an electric arc occurs, switching gases pass through the exhaust channels and cause triggering of the opening contacts to produce the electric cutoff.

Each single-pole switching unit comprises, for at least one exhaust channel, a rotating gate designed to be rotated by the passage of the cutoff gases around an axis of rotation substantially perpendicular to the exhaust channel, the rotation of the gate from a first obstructing position to a second triggering position being designed to actuate triggering means to cause the contacts to open. The axis of rotation of the rotating gate is fastened to the side walls of the discharge channel so as to divide the gate into two non-symmetrical working surfaces, a first and a second surface, which, moving from the first obstruction position to the second triggering position, free two passage sections for gases in the gas exhaust channel.

With this known rotating gate, solid debris builds up in the gas discharge channel, causing obstruction of the channel and preventing the operation of the device multiple times.

SUMMARY OF THE INVENTION

The present invention aims to resolve this drawback, by proposing a single-pole switching unit with a rotating gate both enabling quick triggering and avoiding obstruction of the channel after discharge of the gases.

To that end, according to a first aspect, the invention proposes a single-pole switching unit having a housing comprising:

- a moving contact bridge,
- a pair of fixed contacts cooperating with said moving contact bridge and respectively connected to a current intake conductor,
- two arc cutoff chambers respectively opening onto an opening volume of the moving contact bridge, each cutoff chamber being connected to at least one exhaust channel,

- at least one exhaust channel comprising a rotating gate designed to be rotated around an axis substantially perpendicular to the exhaust channel by the passage of cutoff gases, the rotation of the rotating gate from a first obstruction position to the second triggering position being designed to actuate triggering means to cause the opening of the contact, the rotation of the rotating gate being defined by an angle of rotation, comprised between an initial angle value in the obstruction position and a final angle value.

The rotating gate according to the invention comprises one edge positioned across from an inner wall of the exhaust channel, in the first obstruction position, said edge being positioned at a first distance from said inner wall of the exhaust channel in the first obstruction position, said edge being able to move away from the wall of the exhaust channel during the rotation of the rotating gate, the position of the rotating gate defining at least one gas passage section. The arrangement of the rotating gate and the inner wall is such that the distance between said edge and said inner wall remains constant and equal to said first distance up to a first threshold value of the angle of rotation of the rotating gate, then increases linearly up to a second rotation angle threshold value corresponding to complete opening of the discharge channel.

Advantageously, in the triggering position, the rotating gate reaches an opening position of the exhaust channel, which allows better discharge of the switching gases and avoids any obstruction of the channel.

Advantageously, the single-pole switching unit provided with said rotating gate can perform triggering several times after a short circuit.

The single-pole switching unit according to the invention may also have one or more of the features below, considered independently or according to all technically possible combinations:

- the first distance is less than or equal to 0.2 millimeters;
- the position of the rotating gate defines two passage sections and the total surface area of said sections is constant up to the first rotation angle threshold value of the rotating gate, then increases linearly up to the second rotation angle threshold value corresponding to complete opening of the discharge channel;
- said total surface is smaller than or equal to 7 square millimeters up to the first angle threshold value;
- the first angle threshold value is comprised between 11 and 13 degrees and the second angle threshold value is comprised between 39 and 41 degrees;
- the discharge channel comprises an elbow forming a convex inner zone, the rotating gate being positioned such that said edge of the gate is substantially parallel to the wall of the discharge channel in said convex inner zone for rotation of the rotating gate between the initial angle value and the first angle threshold value.

According to a second aspect, the invention relates to an electric switching unit comprising at least one single-pole switching unit as briefly described above.

According to one feature, the switching unit comprises three single-pole phase units coupled using at least one rod.

BRIEF DESCRIPTION OF THE DRAWINGS

Other features and advantages of the invention will emerge from the description thereof provided below, for information and non-limitingly, in reference to the appended figures, in which.

DETAILED DESCRIPTION OF THE PREFERRED EMBODIMENTS

Figure 1:
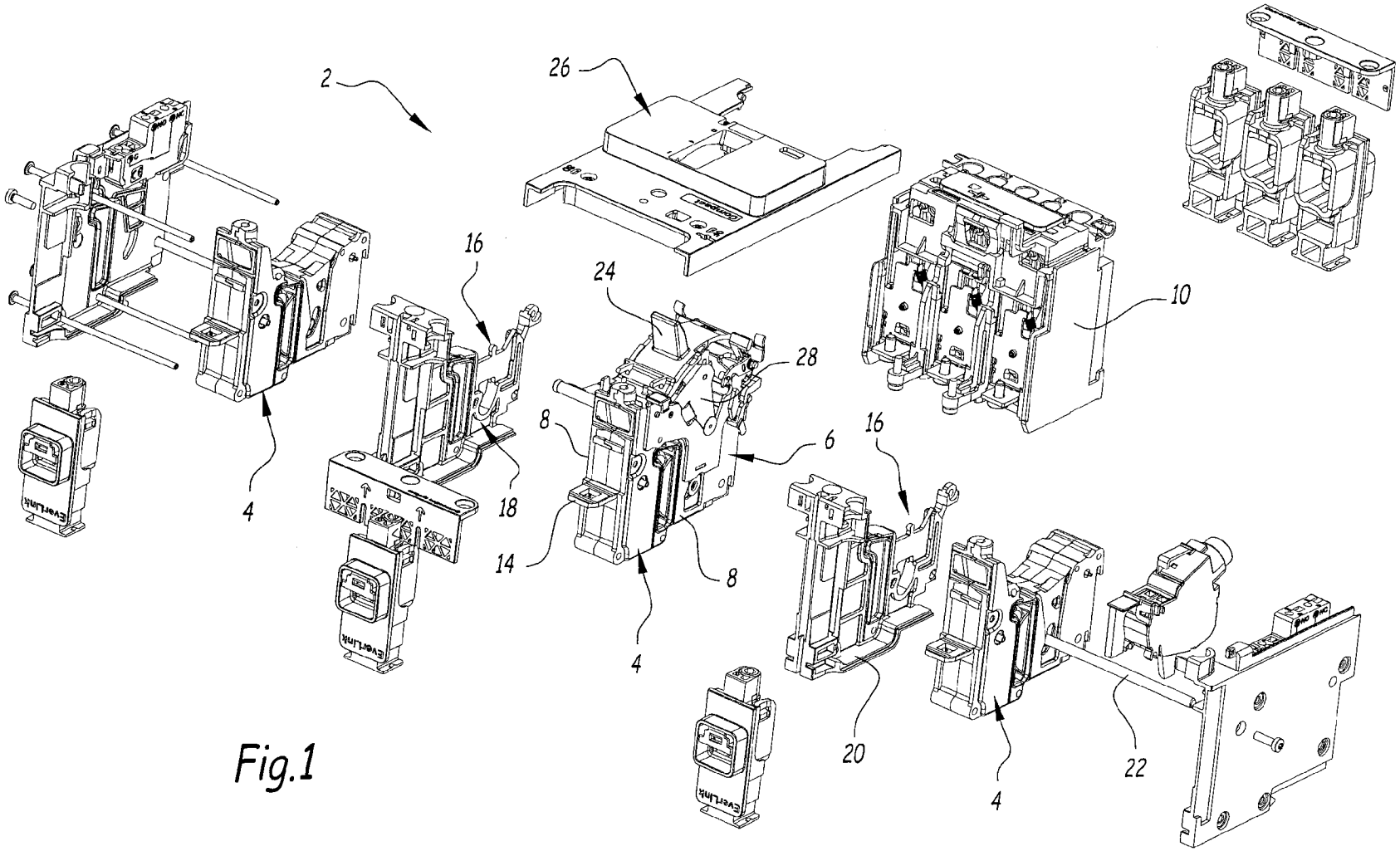
FIG. 1 shows an exploded perspective view of a switching unit comprising single-pole phase units and a triggering unit according to the invention.

FIG. 1 shows an example electric switching unit 2 in an exploded perspective illustration, comprising three single-pole switching units 4.

According to other embodiments that are not shown, the cutoff apparatus may comprise one, two, three or four single-pole switching units.

Each single-pole switching unit 4 makes it possible to cut off a single pole. Each switching unit assumes the form of a flat housing 6, for example made from molded plastic, formed from two large parallel faces 8, separated by a thickness of approximately 23 millimeters (mm) for a caliber of 160 Amperes (A). The housing is preferably formed by two mirror-image symmetrical parts, secured by any suitable means.

Each single-pole switching unit is connected to a triggering unit 10, able to comprise magnetothermal means or electronic means, at a downstream contact area 12 (see FIG. 2) as well as to a current line connected to an upstream contact area 14.

In the embodiment illustrated in FIG. 1, the single-pole switching units are assembled using spacers 16, which are for example made from molded plastic, and comprises a central partition 18 designed to be parallel to the large faces 8 of the single-pole switching units 4. The gripping of the spacers 16 on each other is improved by bottom rims 20.

The single-pole switching units are designed to be driven simultaneously and coupled to that end by at least one rod 22.

One of the single-pole switching units comprises a handle 24, able to be housed in the nose 26 of the apparatus, and to control a mechanism 28 for actuating the electric contacts.

Figure 2:
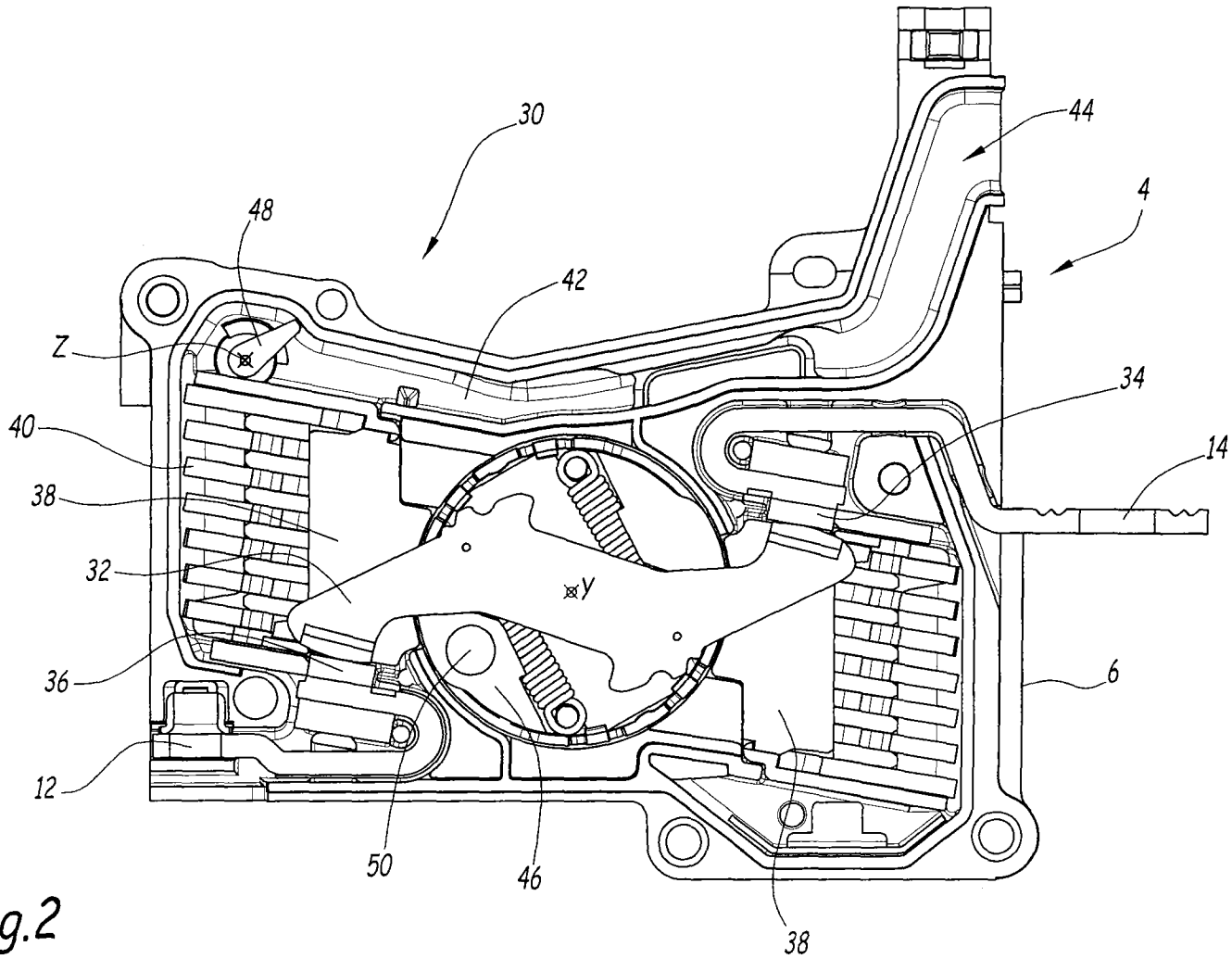
FIG. 2 shows a cross-sectional view of the inside of a single-pole switching unit according to one embodiment of the invention.

FIG. 2 shows a more detailed view of the switching unit 30 housed in the housing 6, according to an embodiment in which it involves a double rotating cutoff mechanism, suitable for applications up to 800 A.

The switching unit 30 comprises a moving contact bridge 32 comprising a contact area at each end. It comprises a pair of fixed contact 34, 36, each fixed contact being designed to cooperate with a contact pad of the moving contact bridge 32. A first fixed contact 34 is designed to be connected to the current line by the upstream contact area 14. A second fixed contact 36 is designed to be connected to the triggering unit 10 by the downstream context area 12.

The moving contact bridge 32 is mounted between an open position, in which the contact areas are separated from the fixed contacts 34, 36, and a closed position, which is an on position for the electric current, in which the contact areas are in contact with each of the fixed contacts 34, 36.

The single-pole switching unit 4 comprises two arc cutoff chambers 38 for extinguishing electric arcs. Each arc cutoff chamber 38 comprises at least one stack of at least two de-ionizing fins 40 separated from each other by a switching gas exchange space.

Each arc cutoff chamber 38 comprises at least one outlet connected to at least one exhaust channel 42 for the switching gases, designed to discharge the gases through at least one emerging orifice 44.

According to one particular embodiment, the moving contact bridge 32 is rotatable around an axis of rotation Y. The moving contact bridge 32 is mounted floating in a rotating bar 46 interpolated between the two side faces 8 of the housing 6.

At least one exhaust channel 42 comprises a rotating gate 48 designed to be rotated by the passage of the switching gases. The rotating gate 48 is rotated around an axis Z substantially perpendicular to the exhaust channel 42. The rotation from a first obstruction position to a second triggering position is designed to free the actuating mechanism 28 to cause the contacts 34, 36 to open.

The single-pole switching units 4 are designed to be driven simultaneously, and are coupled to that end by at least one rod 22, in particular at the bar 46, for example by orifices 50. In FIG. 2, the rotating gate 48 is in the first obstructing position, illustrated in more detail in FIGS. 3 and 4 described below.

Figure 3:
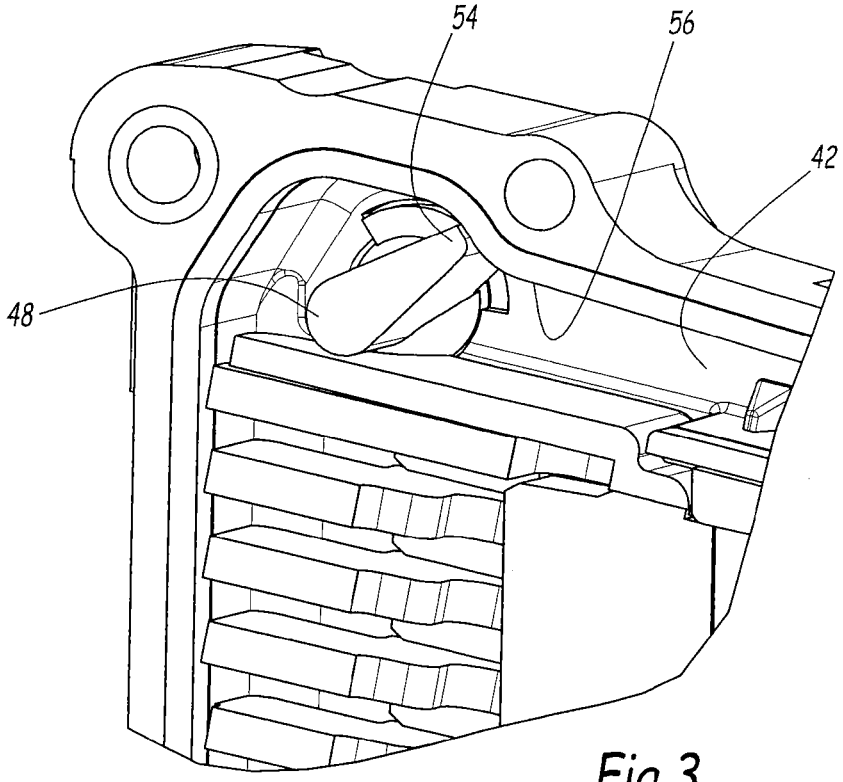
FIGS. 3 and 4 illustrate an operating detail of a rotating gate of a single-pole switching unit in the obstruction position according to one embodiment of the invention.
Figure 4:
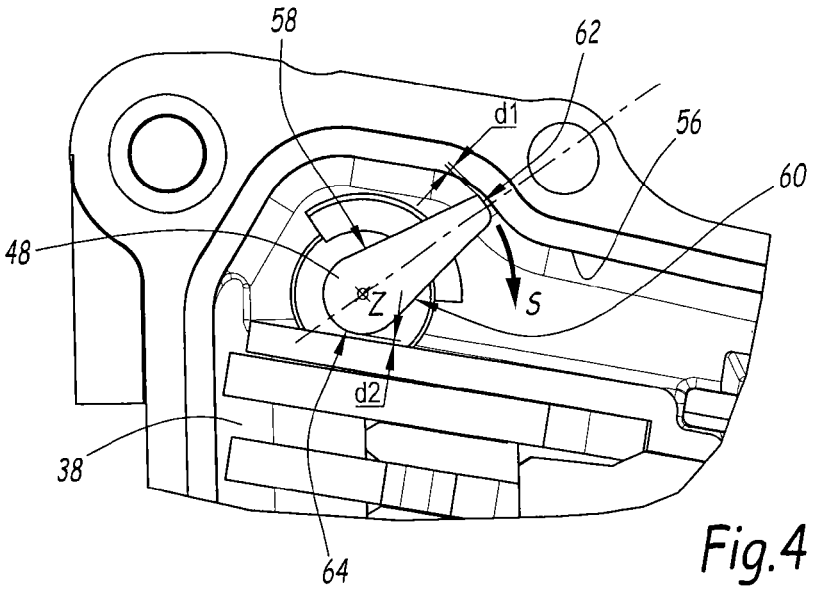

FIGS. 3 and 4 provide a more detailed illustration of the first obstruction position of the rotating gate 48, in which the edge 54 of the rotating gate cooperates with an inner wall 56 of the discharge channel 42.

The edge 54 of the rotating gate is formed at the junction of a first face 58 and a second face 60 of the rotating gate, substantially parallel to the first face, the first face 58 extending in the discharge channel so as to restrict the discharge gas passage.

The edge 54 is positioned across from the inner wall 56, at a first predetermined distance d1, which is preferably smaller than 0.2 millimeters. Thus, in this first position of the rotating gate 48, a quasi-total obstruction of the discharge channel is produced.

Nevertheless, in the obstructing position, a first switching gas passage section 62 is formed between the edge 54 of the rotating gate 48 and the inner wall 56 of the discharge channel 42.

In the illustrated example, the rotating gate 48 is mounted near the arc cutoff chamber 38 and the moving contact bridge 32, at a second predetermined distance d2, and frees a second gas passage section 64. The distance d2 is chosen to be very small, preferably approximately 0.15 millimeters, and provides a gap necessary for the movement of the rotating gate.

Preferably, the total surface area of the first gas passage section 62 and the second gas passage section 64 is 7 $mm^2$ (square millimeters) in the first obstructing position.

When the rotating gate 48 is in the first obstructing position, the rotating gate has an initial angular position in the first obstructing position.

The rotating gate is rotated in the direction of rotation S toward a complete open position in which it is positioned in a final angular position. The travel of the rotating gate corresponds to an evolution of an angle of rotation $\Phi$ between an initial angular value and a final angular value. The travel corresponds to the necessary rotation of a lever (not shown) in order to release the actuating mechanism 28.

The angular travel between the initial angular value and the final angular value is comprised between 39° and 41°, preferably equal to 40°.

Advantageously, the distance d between the edge 54 and the inner wall 56 evolves with the angle of rotation $\Phi$ as follows: it remains constant and equal to said first distance d1 as long as the angle of rotation is below a first angle threshold value, and it increases linearly up to a second rotation angle threshold value preferably equal to the final angular value corresponding to complete opening of the discharge channel.

Preferably, the first angle threshold value is equal to 12°, and more generally comprised between 11° and 13°.

Figure 5:
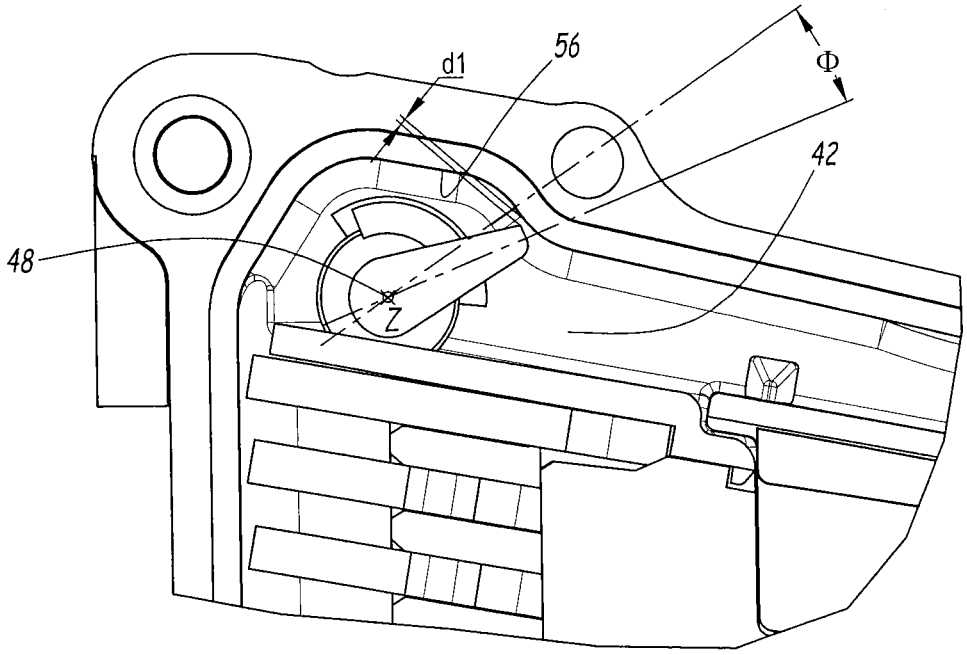
FIG. 5 provides a detailed illustration of the operation of a rotating gate of a single-pole switching unit in the first part of travel.

FIG. 5 illustrates the position of the rotating gate 48 when it leaves the first obstructing position, and remains, during that first part of its travel, at a constant distance equal to d1 from the inner wall 56 of the discharge channel 42, the angle of rotation Φ being smaller than the first threshold value.

Figure 6:
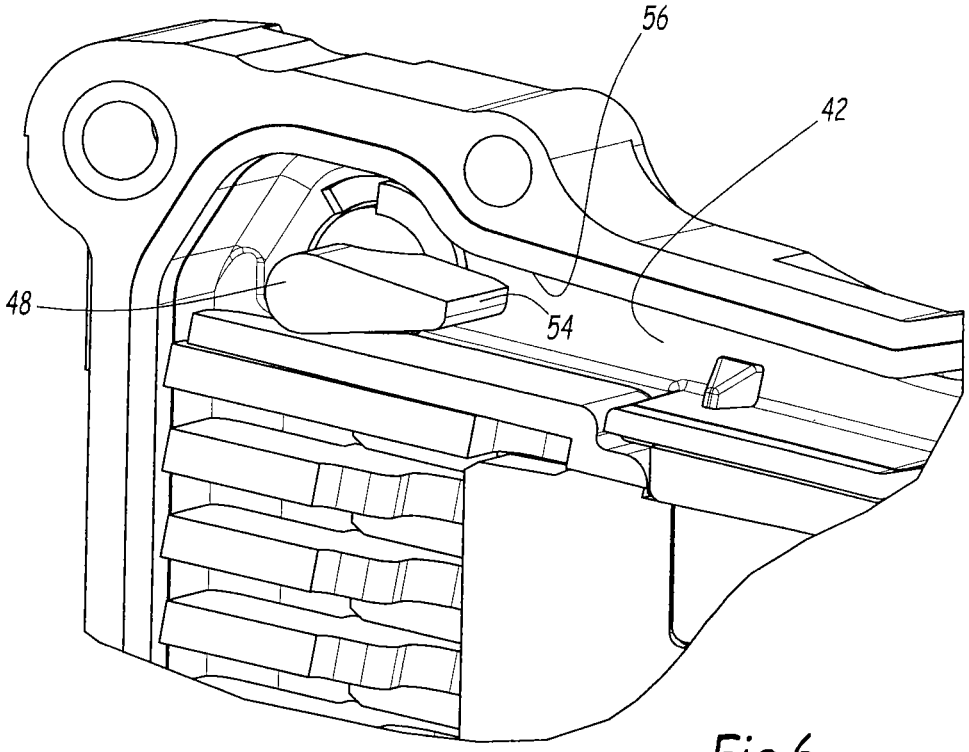
FIGS. 6 and 7 illustrate an operating detail of a rotating gate of a single-pole switching unit in the triggering position according to one embodiment of the invention.
Figure 7:
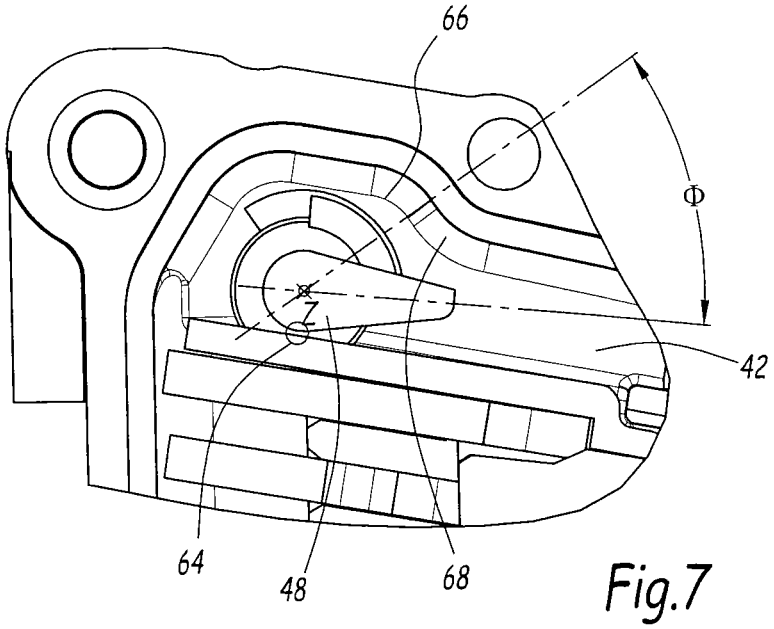

FIGS. 6 and 7 illustrate the second triggering position of the rotating gate 48, in a completely open configuration following the release of switching gases in the cutoff chambers 38.

In the illustrated embodiment, the discharge channel 42 comprises an elbow 66, the inner wall 56 of the discharge channel forming a convex zone 68. The axis of rotation of the rotating gate 48 is positioned near the convex zone 68, such that the edge 54 is positioned across from a portion of the convex zone 68, on one side of the bending point of that convex zone 66. The axis of rotation Z is positioned relative to the gas flow stream in a zone of the discharge channel where their flow rate is low and therefore not very favorable to creating a pressure difference causing a rotational torque.

Figure 8:
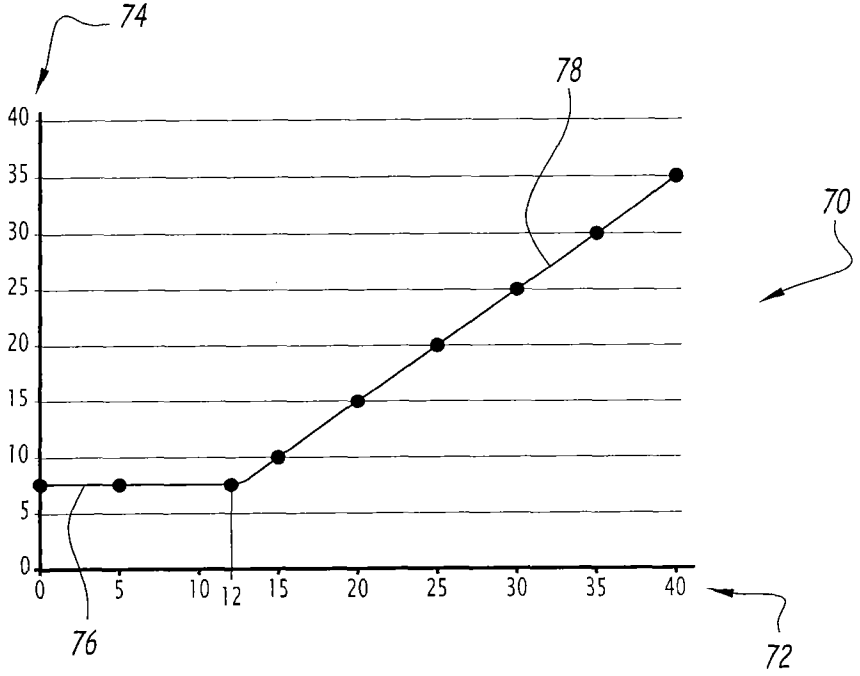
FIG. 8 is a graph illustrating the evolution of a gas passage section dimension as a function of the angle of rotation of the rotating gate according to one embodiment of the invention.

FIG. 8 shows an evolution profile of the total surface area of the first 62 and second 64 gas passage sections based on the angle of rotation Φ of the rotating gate 48 according to one embodiment.

In the graph 70, the x-axis 72 shows the value of the angle of rotation Φ of the rotating gate, which evolves between the initial angle value 0° and the final angle value of 40°. The y-axis 74 shows the gas passage section surface area in $mm^2$ (square millimeters). As can be seen, in the illustrated embodiment, the rotating gate is arranged across from the discharge channel such that the section surface area remains constant and equal to 7 $mm^2$ over a first portion 76, for an angle of rotation Φ of the rotating gate comprised between 0° and 12°, then increases by a linear portion 78 between 7 $mm^2$ and 35 $mm^2$ for an angle of rotation of 40°. The value of 35 $mm^2$ is substantially equal to the surface area of the section of the discharge channel 42.

Figure 9:
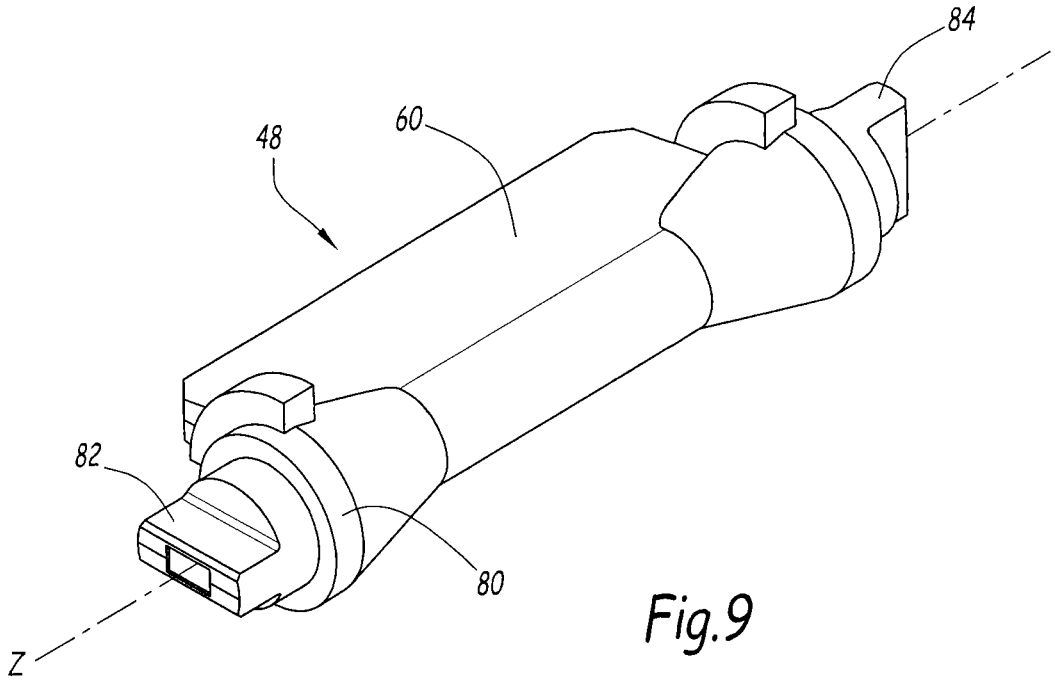
FIG. 9 shows a perspective view of a rotating gate according to the invention.

FIG. 9 illustrates a rotating gate according to one embodiment of the invention, in perspective view. The axis of rotation Z of the gate 48 comprises shoulders 80 bearing on the inner side surfaces of the phase unit.

The ends 82, 84 of the axis of rotation Z of the rotating gate are useful to connect the respective rotating valves of the single-pole phase units in a modular electric switching unit such as the device 2 illustrated in FIG. 1. The mechanical coupling between all of the rotating gates of the phase units makes it possible to ensure transmission of the rotational movement from one gate to the others, in a switching unit with several single-pole switching units.

The invention claimed is:

1. A single-pole switching unit having a housing comprising:

a moving contact bridge;

a pair of fixed contacts cooperating with the moving contact bridge and respectively connected to a current intake conductor; and two arc cutoff chambers respectively opening onto an opening volume of the moving contact bridge, each arc cutoff chamber being connected to at least one exhaust channel;

the at least one exhaust channel comprising a rotating gate designed to be rotated around an axis substantially perpendicular to the exhaust channel by a passage of cutoff gases, a rotation of the rotating gate from a first obstruction position to a second triggering position being designed to actuate a triggering device to cause an opening of the moving contact bridge, the rotation of the rotating gate being defined by an angle of rotation, comprised between an initial angle value in the first obstruction position and a final angle value, wherein the rotating gate comprises one edge positioned across from an inner wall of the exhaust channel, in the first obstruction position, the edge being positioned at a first distance from the inner wall of the exhaust channel in the first obstruction position, the edge being movable away from the inner wall of the exhaust channel during the rotation of the rotating gate, a position of the rotating gate defining at least one gas passage section, an arrangement of the rotating gate and the inner wall is such that a distance between the edge and the inner wall remains constant and equal to the first distance up to a first threshold value of the angle of rotation of the rotating gate, then increases linearly up to a second threshold value of the angle of rotation of the rotating gate corresponding to a complete opening of the exhaust channel, the first threshold value of the angle of rotation being smaller than the second threshold value of the angle of rotation of the rotating gate so as to ensure a quick cutoff triggering.

2. The single-pole switching unit according to claim 1, wherein the first distance is less than or equal to 0.2 millimeters.

3. The single-pole switching unit according to claim 1, wherein a position of rotating gate defines two passage sections and a cross-sectional area of the two passage sections is constant up to the first threshold value of the angle of rotation, then increases linearly up to the second threshold value of the angle of rotation corresponding to the complete opening of the exhaust channel.

4. The single-pole switching unit according to claim 3, wherein the cross-sectional area is smaller than or equal to 7 square millimeters up to the first threshold value of the angle of rotation.

5. The single-pole switching unit according to claim 1, wherein the first threshold value of the angle of rotation is between 11 and 13 degrees and the second threshold value of the angle of rotation is between 39 and 41 degrees.

6. The single-pole switching unit according to claim 1, wherein the exhaust channel comprises an elbow forming a convex inner zone, and the rotating gate is positioned such that the edge of the rotating gate is substantially parallel to the inner wall of the exhaust channel in the convex inner zone for the rotation of the rotating gate between the initial angle value and the first threshold value of the angle of rotation.

7. A switching unit, comprising at least one single-pole switching unit according to claim 1.

8. The switching unit according to claim 7, comprising three single-pole switching units coupled using at least one rod.

* * * * *